US005397990A

United States Patent [19]

Ohsawa

[11] Patent Number: 5,397,990

[45] Date of Patent: Mar. 14, 1995

[54] DEVICE FOR ACCURATELY DETECTING ION CURRENT OF INTERNAL COMBUSTION ENGINE BY MASKING NOISE GENERATED BY AN IGNITION COIL

[75] Inventor: Toshio Ohsawa, Hyogo, Japan

[73] Assignee: Mitsubishi Denki Kabushiki Kaisha, Tokyo, Japan

[21] Appl. No.: 955,064

[22] Filed: Oct. 1, 1992

[30] Foreign Application Priority Data

Oct. 4, 1991 [JP] Japan ..... 3-257284

[51] Int. Cl.[6] ..... F02P 17/00

[52] U.S. Cl. ..... 324/399; 73/117.3; 324/393

[58] Field of Search ..... 324/388, 391, 393, 399; 123/425; 73/116, 117.3

[56] References Cited

U.S. PATENT DOCUMENTS

| | | | |
|---|---|---|---|
| 4,762,106 | 8/1988 | Blauhut | 123/425 |
| 4,987,771 | 1/1991 | Iwata | 324/393 X |
| 5,067,462 | 11/1991 | Iwata et al. | 123/414 |
| 5,087,882 | 2/1992 | Iwata | 324/388 |
| 5,180,984 | 1/1993 | Murata et al. | 324/399 |
| 5,189,373 | 2/1993 | Murata et al. | 324/399 |

FOREIGN PATENT DOCUMENTS

| | | |
|---|---|---|
| 3342723 | 7/1986 | Germany . |
| 3934310 | 4/1990 | Germany . |
| 4132858 | 4/1992 | Germany . |

OTHER PUBLICATIONS

Wenzlawski et al., "Ionenstrommessung an Zundkerzen von Ottomotoren als Klopferkennungsmittel," *MTZ Motortechnische Zeitschrift*, vol. 51, No. 3, pp. 118–122.

*Primary Examiner*—Gerard R. Strecker

*Attorney, Agent, or Firm*—Sughrue, Mion, Zinn, Macpeak & Seas

[57] ABSTRACT

In an ion current detecting device for an internal combustion engine, an ion current detecting circuit for detecting an ion current produced when the gas mixture is burnt by spark discharges between the electrodes of a spark plug operates to mask the detection signal of the ion current for predetermined periods of time in the intervals in which noise pulses are produced in association with excitation and unexcitation of ignition coil. Hence, the noise pulses are eliminated from the detection signal, whereby it can be positively determined from the presence or absence of the detection signal whether or not the gas mixture has been burnt.

3 Claims, 5 Drawing Sheets

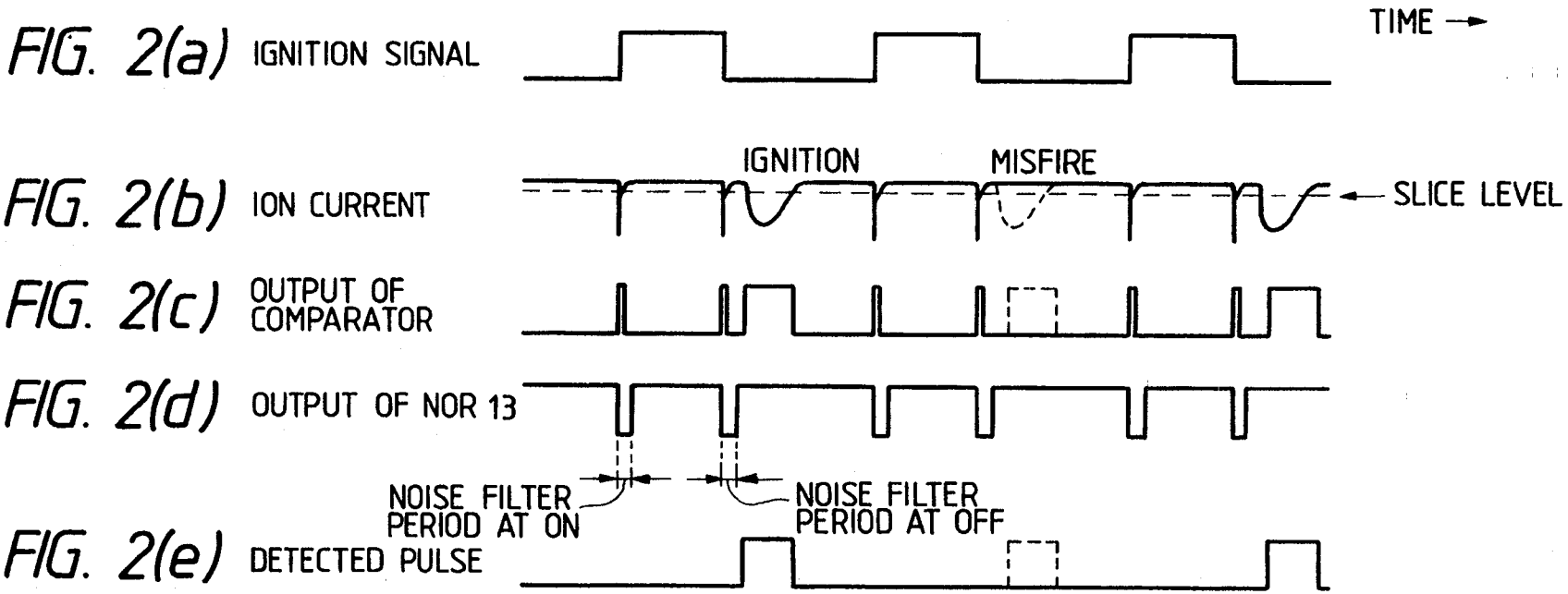
TIME →
SLICE LEVEL
MISFIRE
IGNITION
NOISE FILTER PERIOD AT OFF
NOISE FILTER PERIOD AT ON
FIG. 2(a) IGNITION SIGNAL
FIG. 2(b) ION CURRENT
FIG. 2(c) OUTPUT OF COMPARATOR
FIG. 2(d) OUTPUT OF NOR 13
FIG. 2(e) DETECTED PULSE

DEVICE FOR ACCURATELY DETECTING ION CURRENT OF INTERNAL COMBUSTION ENGINE BY MASKING NOISE GENERATED BY AN IGNITION COIL

BACKGROUND OF THE INVENTION

This invention relates to an ion current detecting device for an internal combustion engine which detects an ion current which is produced in the gap between the electrodes of a spark plug when the engine is in the process of combustion.

One such ion current detecting device which has previously been disclosed by the present applicant will be described in accordance with FIG. 5.

In FIG. 5, an ignition coil 1 is provided with a primary winding la and a secondary winding 1*b*; a power transistor 2 is connected between the primary winding la and ground, to control the flow of primary current; and a spark plug 3 is connected to one of two terminals of the secondary winding 1*b* where an ignition high voltage is provided. The spark plug burns the gas mixture in the internal combustion engine when the ignition high voltage is applied to it. Further in FIG. 5, a capacitor 4 is connected to the other terminal of the secondary winding 1*b* which is on the side of positive polarity; a resistor 5 is connected between the capacitor 4 and ground, to convert an ion current into a voltage; a diode 6 is connected in parallel to the resistor 5; a Zener diode 7 is connected between the other terminal of the secondary winding 1*b* and a coil power source 10; an AC coupler 8 obtains only an AC component from a voltage developed across the resistor 5; a comparator 9 compares a voltage value provided by the AC coupler 8 with a predetermined comparison level; and the output terminal 11*a* of the comparator 9 supplies a pulse signal when an ion current is detected.

The ion current detecting device thus organized operates as follows:

When, at the time of ignition of the internal combustion engine, the power transistor 2 is rendered nonconductive (off) to cut off the primary current of the primary winding 1*a*, an ignition high voltage of negative polarity is induced in the secondary winding 1*b*, so that spark discharges occur between the electrodes of the spark plug 3 to burn the gas mixture in the internal combustion engine. In this operation, as the gas mixture burns, ionization takes place, thus forming ions. In this case, the electrodes of the spark plug 3 act as electrodes for detection of ion current after the occurrence of spark discharges. The bias of positive polarity of the capacitor 4 moves electrons, so that an ion current flows. When the ion current flows in this manner, a voltage is developed across the resistor 5. The AC component of the voltage thus developed is detected by the comparator 9, where it is compared with the predetermined comparison level, as a result of which a pulse signal is provided at the output terminal 11*a*. The pulse signal is detected to confirm the combustion of the mixture gas.

The conventional ion current detecting device, being designed as described above, is disadvantageous in the following points:

When the ignition coil 1 is excited (on) and unexcited (off), noise pulses are produced in the ion current detecting path by the electro-magnetic induction of the ignition coil 1. That is, with the conventional ion current detecting device, pulses are detected not only when the gas mixture is burnt but also when it is not (misfire). In order to eliminate this difficulty, it is necessary to additionally provide means for determining the ion current from the width of the pulse detected indicating whether or not the gas mixture has been burnt. That is, in the conventional ion current detecting device, the method of determining whether or not the gas mixture has been burnt is rather intricate, and low in reliability.

SUMMARY OF THE INVENTION

Accordingly, this invention has been attained to eliminate the above-described difficulties accompanying a conventional ion current detecting device for an internal combustion engine.

More particularly, an object of the invention is to provide an ion current detecting device for an internal combustion engine which is so improved that the noise pulses are eliminated from the detection pulse signal which are produced in association with the on-off operation of the ignition coil, thus being able to readily and positively determine whether or not the gas mixture has been burnt.

The foregoing object and other objects of the invention have been achieved by the provision of a device for detecting ion current of an internal combustion engine comprising: an ignition coil for generating an ignition high voltage for the internal combustion engine; a spark plug to which the ignition high voltage generated by the ignition coil is applied, for ignition of the gas mixture in the engine; an ion current detecting means for detecting an ion current which is produced when said gas mixture is burnt; and means for masking part of the signals from the current detecting means depending upon the excitation of the ignition coil when the ignition coil generates the ignition high voltage.

With the device of the invention, in the intervals in which noise pulses are produced in association with the excitation and non-excitation of the ignition coil, the ion current detecting circuit masks the detection signal of the ion current so as to eliminate the noise pulses from the detection pulse signal, thereby to obtain the aimed true detection signal.

The nature, principle, and utility of the invention will be more clearly understood from the following detailed description of the invention when read in conjunction with the accompanying drawings.

BRIEF DESCRIPTION OF THE DRAWING(S)

In the accompanying drawings:

FIGS. 1(*a*) and 1(*b*) are circuit diagrams, partly as block diagrams, for a description of the operation of one example of an ion current detecting device for an internal combustion engine, which constitutes a first embodiment of the invention, showing the arrangement thereof;

FIGS. 2(*a*), 2(*b*), 2(*c*), 2(*d*) and 2(*e*) are time charts for a description of the operation of the device shown in FIG. 1(*a*) and 1(*b*);

FIGS. 3(*a*) and 3(*b*) are circuit diagrams, partly as block diagrams, for a description of the operation of another example of the ion current detecting device for an internal combustion engine, which constitutes a second embodiment of the invention, showing the arrangement thereof;

FIG. 4(*a*), 4(*b*), 4(*c*), 4(*d*) and 4(*e*) are time charts for a description of the operation of the device shown in FIG. (*a*) and 3(*b*); and FIG. 5 is a circuit diagram, partly as a block diagram, showing the arrangement of a conventional ion current detecting device for an internal combustion engine.

DETAILED DESCRIPTION OF THE INVENTION

Preferred embodiments of this invention will be described with reference to the accompanying drawings.

Figure 5:
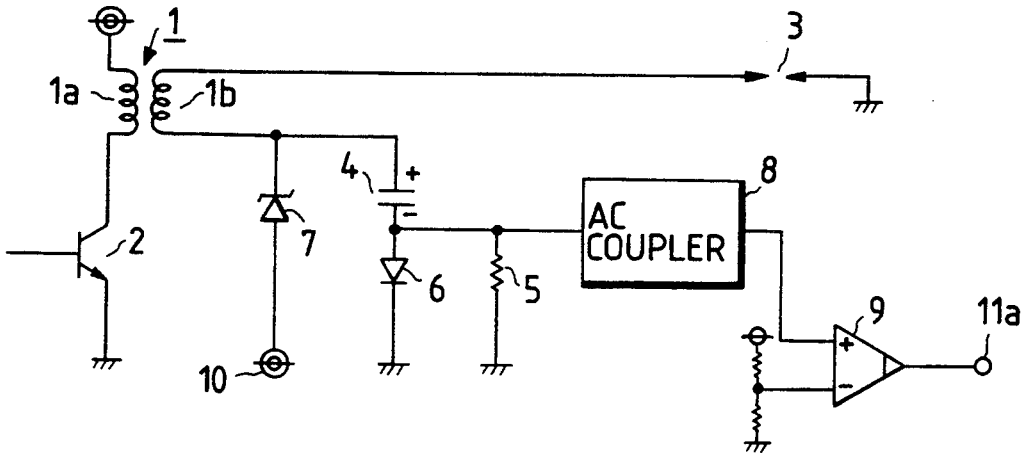

An ion current detecting device for an internal combustion engine, which constitutes a first embodiment of the invention, will be described with reference to FIGS. 1(*a*) and 1(*b*), in which parts corresponding functionally to those which have been described with reference to FIG. 5 (the prior art) are therefore designated by the same reference numerals.

Figure 1A:
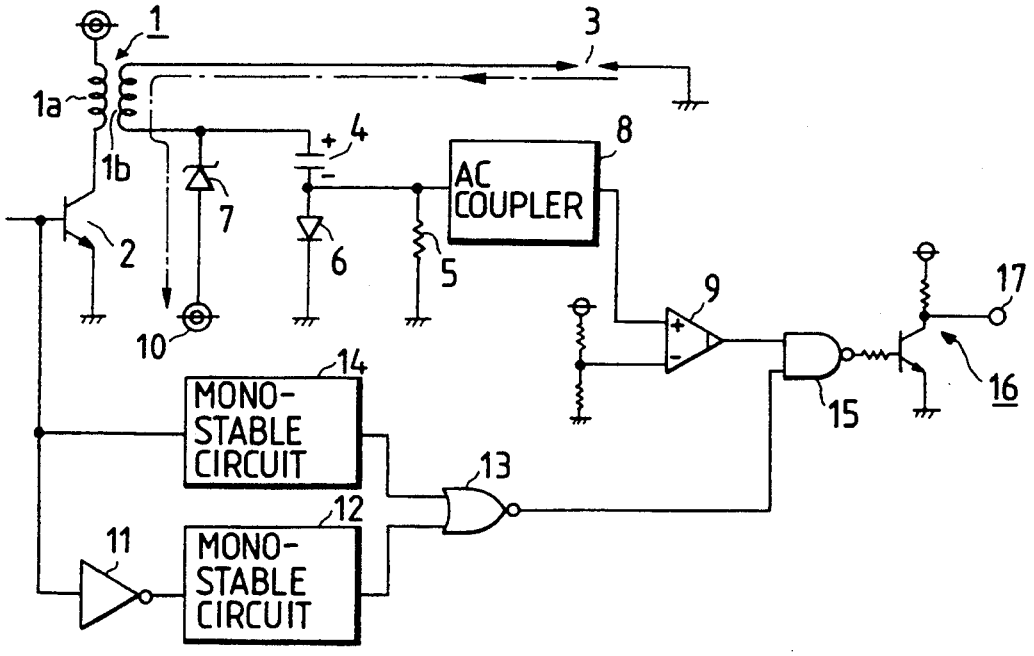
Figure 1B:
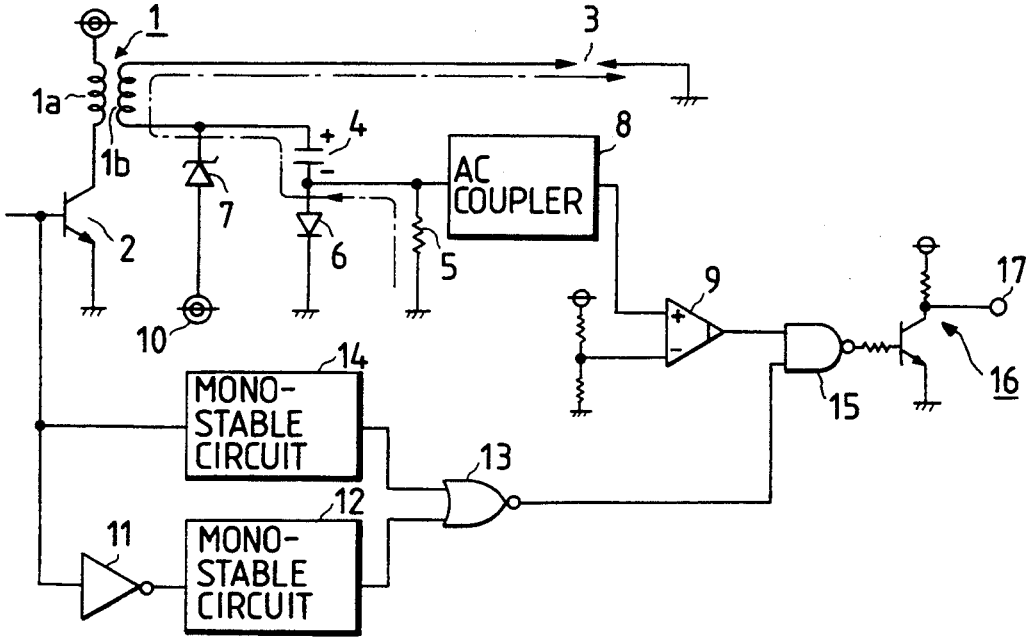

In FIGS. 1(*a*) and 1(*b*), an inverter 11 inverts a signal applied to the base of the power transistor 2. A mono-stable circuit 12 receives the output of the inverter 11, to produce a pulse for a predetermined period of time from the time of non-excitation (off) of the ignition coil 1. Another mono-stable circuit 14 receives the base signal of the power transistor 2, to produce a pulse for a predetermined period of time from the time of excitation (on) of the ignition coil 1. A NOR circuit 13 receives the outputs of the mono-stable circuits 12 and 14. A NAND circuit 15 is supplied with the outputs of the comparator 9 and the NOR circuit 13. An inversion amplifier 16 subjects the output of the NAND circuit 15 to inversion and amplification, to provide a combustion determining detection signal at its output terminal 17.

The operation of the ion current detecting device thus organized will be described with reference to FIGS. 1(*a*) and 1(*b*).

At the time of ignition of the internal combustion engine, an ignition high voltage of negative polarity (about −10 to −25 KV) is produced in the secondary winding 1*b*. As a result, a discharge current flows in the path (the spark plug 3→the secondary winding 1*b*→the Zener diode 7) indicated by the arrow of one-dot chain line in FIG. 1(*a*), so that spark discharges occur between the electrodes of the spark plug 3, to burn the gas mixture in the engine.

On the other hand, the discharge current charges the capacitor 4 so that the latter is polarized as shown. The charge voltage of the capacitor 4 can be determined due to a value of the Zener diode 7.

In this operation, similarly as in the case of the conventional device, ionization takes places when the gas mixture is burnt, and ions are formed. In this case, the bias of positive polarity of the capacitor 4 moves electrons, so that an ion current flows in the path (the resistor 5→the capacitor 4→the secondary winding 1*b*→the spark plug 3) indicated by the arrow of one-dot chain line in FIG. 1(*b*). As the ion current flows in this way, a voltage is developed across the resistor 5. The AC component of the voltage is detected by the AC coupler 8, and it is compared with the comparison level in the comparator 9, to provide a detection pulse. On the other hand, similarly as in the case of the conventional device, the comparator 9 outputs noise pulses when the ignition coil 1 is excited (on) and non-excited (off).

On the other hand, with the timing that the power transistor 2 is rendered conductive (on), the mono-stable circuit 14 provides a constant time pulse; and with the timing that the power transistor 2 is rendered non-conductive (off), the mono-stable circuit 12 provides a constant time pulse. The constant time pulses provided by those mono-stable circuits 12 and 14 are applied to the NOR circuit 13, so that the latter 13 outputs a pulse for masking the detection pulse. The output pulse of the NOR circuit 13 and the output pulse of the comparator 9 are applied to the NAND circuit 15, the output of which is applied to the inversion amplifier 16, where it is subjected to inversion and amplification. Hence, only the aimed true detection pulse free from the noise pulses is provided at the output terminal 17 of the inversion amplifier 16. That is, the noise pulses which are detected as detection pulses when the ignition-coil 1 is excited (on) and non-excited (off),are not provided at the output terminal 17, and instead the aimed true detection pulse is provided at the output terminal.

The above-described operation of the device will become more apparent when referred to FIG. 2. FIG. 2(*a*) shows an ignition signal for driving the ignition coil. FIG. 2(*b*) shows an ion current produced when the gas mixture is burnt. FIG. 2(*c*) shows the output signal of the comparator 9. FIG. 2(*d*) shows a noise filtering output pulse signal of the NOR circuit. FIG. 2(*e*) shows the detection pulse signal at the output terminal 17. The output pulse signals shown in FIG. 2(*c*) and 2(*d*) are applied to NAND circuit, so that the noise pulses produced in association with excitation (on) and non-excitation (off) of the ignition coil 1 are eliminated from the output pulse signal shown in FIG. 2(*c*). Hence, it is determined from the presence or absence of the detection signal whether or not the gas mixture has been burnt.

Figure 3A:
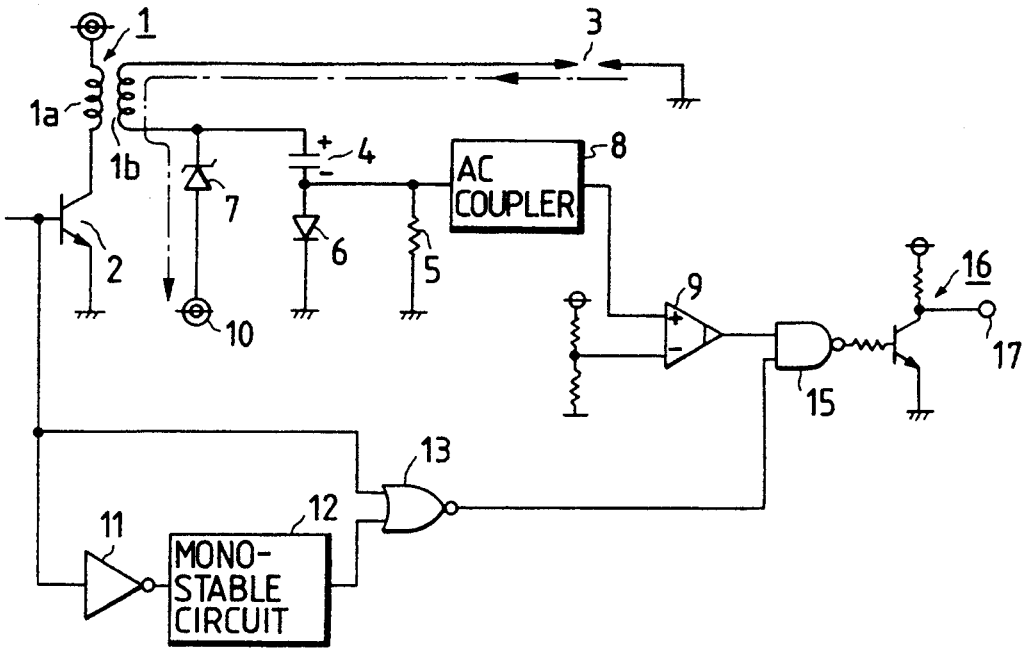
Figure 3B:
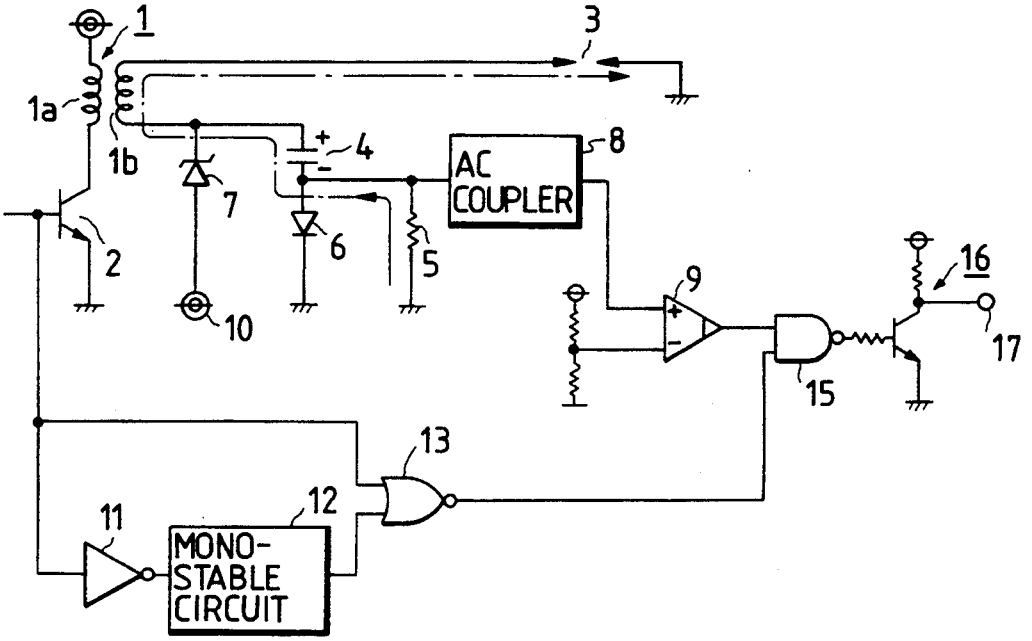

A second embodiment of the invention is as shown in FIG. 3. The second embodiment is different from the above-described first embodiment only in that the mono-stable circuit 14 of FIG. 1 is not employed in the second embodiment. In FIG. 3, parts corresponding functionally to those which have been already described with reference to FIG. 1 are therefore designated by the same reference numerals (1 through 13, and 15 through 17). FIGS. 3(*a*) and 3(*b*) correspond to FIGS. 1(*a*) and 1(*b*), respectively.

The operation of the second embodiment will be described; however, for simplification in description, the operation which is the same as that in the first embodiments will be omitted.

The comparator 9 outputs a detection pulse signal. In this case, with the timing that the power transistor is rendered non-conductive (off), the mono-stable circuit 12 produces a constant time pulse. The output pulse of the mono-stable circuit 12, and the base signal of the power transistor 2 are applied to the NOR circuit 13, so that the latter 13 outputs a pulse for masking the detection pulse. The output of the NOR circuit 13, and the output of the comparator 9 are applied to the NAND circuit 15, so that the detection pulse signal is provided at the output terminal 17 which is obtained by removing the noise pulses from the output pulse signal of the comparator 9 which are produced when the ignition coil 1 is excited (on)-and non-excited (off).

Figures 4A, 4B, 4C, 4D, 4E:
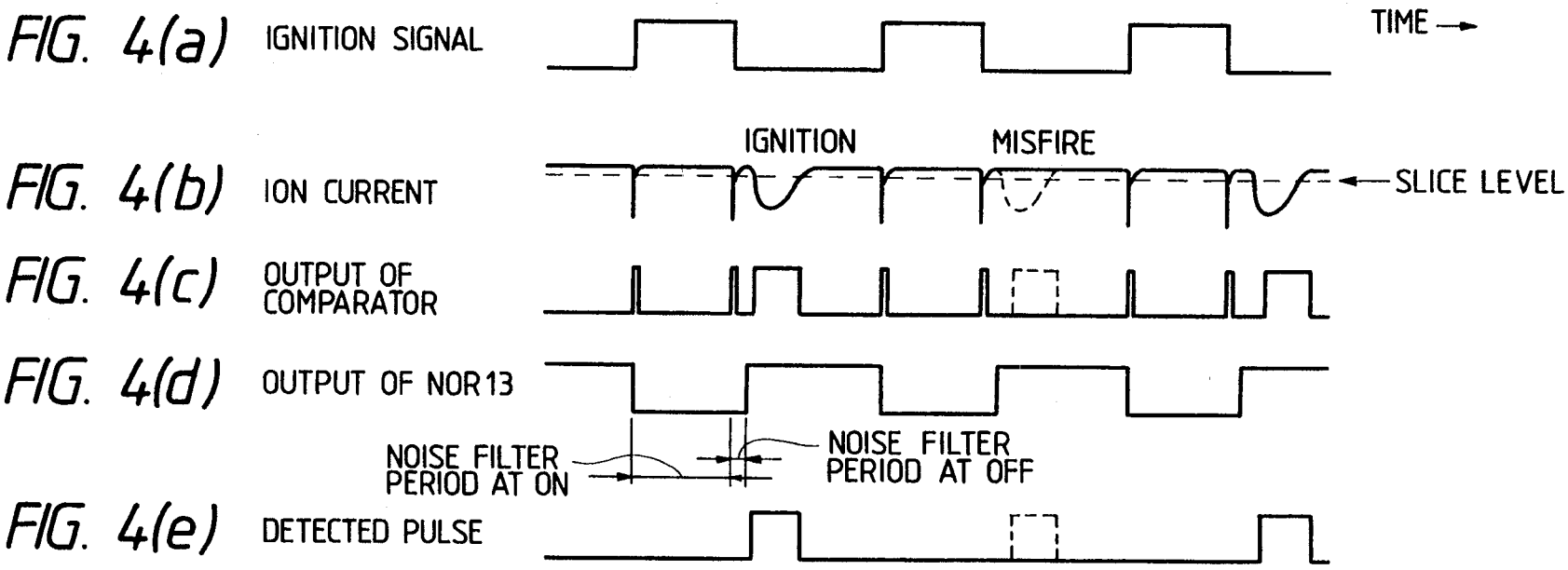

The operation of the second embodiment will become more apparent from a timing chart of FIG. 4. FIG. 4(*a*) shows an ignition signal for driving the ignition coil. FIG. 4(*b*) shows an ion current produced when the gas mixture is burnt. FIG. 4(*c*) shows the output pulse signal of the comparator 9 in FIG. 3. FIG. 4(*d*) shows a noise filtering output pulse signal of the NOR circuit 13 in FIG. 3. FIG. 4(*e*) shows the detection pulse signal at the output terminal 17.

In the above-described embodiments, the ion current is detected by converting it into voltage; however, the invention is not limited thereto or thereby. That is, any other suitable method may be employed for detection of the ion current.

As was described above, in the ion current detecting device of the invention, the detection signal of the ion current is masked for predetermined periods of time in the ion current detecting intervals and in the intervals other than the ion current detecting intervals, so that the noise pulses are eliminated from the detection pulse signal which are produced when the ignition coil is excited and non-excited. Hence, it can be readily and positively determined from the presence or absence of the detection signal whether or not the gas mixture has been burnt.

While there has been described in connection with the preferred embodiments of this invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A device for detecting ion current of an internal combustion engine comprising:

an ignition coil for generating an ignition high voltage for said internal combustion engine;

a spark plug to which the ignition high voltage generated by said ignition coil is applied for ignition of a gas mixture in said internal combustion engine;

an ion current detecting means coupled to said ignition coil for detecting an ion current which is produced when said gas mixture is burnt and for outputting a detection signal; and masking means, coupled to the output of said ion current detecting means and responsive to a signal for controlling an excitation state of said ignition coil, for masking noise from said detection signal resulting from a change in said excitation state of said ignition coil when excitation of the ignition coil is initiated and when excitation of the ignition coil is terminated in order to prevent supply of the noise to said detection signal.

2. A device according to claim 1, wherein said masking means masks noise from said detection signal from said ion current detecting means for a predetermined period of time beginning when an excitation state of said ignition coil is initiated and for a predetermined period of time beginning when an excitation state of said ignition coil is terminated.

3. A device according to claim 1, wherein said masking means masks noise in said ion current for a period of time beginning when an excitation state of said ignition coil is initiated and for a predetermined period of time beginning when an excitation state of said ignition coil is terminated.

* * * * *